US006569300B1

(12) United States Patent
Assenmacher

(10) Patent No.: US 6,569,300 B1
(45) Date of Patent: May 27, 2003

(54) STEEL-CLAD CATHODE FOR ELECTROLYTIC REFINING OF COPPER

(75) Inventor: William Assenmacher, Tucson, AZ (US)

(73) Assignee: T. A. Caid Industries Inc., Tucson, AZ (US)

( * ) Notice: Subject to any disclaimer, the term of this patent is extended or adjusted under 35 U.S.C. 154(b) by 0 days.

(21) Appl. No.: 09/504,257

(22) Filed: Feb. 15, 2000

(51) Int. Cl.[7] ..... B23H 3/04

(52) U.S. Cl. ..... 204/286.1; 204/288.2; 204/297.01; 204/280; 204/281; 205/292; 205/575; 205/576

(58) Field of Search ..... 205/575, 576, 205/292; 204/286.1, 288.2, 297.01, 279, 280, 281

(56) References Cited

U.S. PATENT DOCUMENTS 4,882,027 A * 11/1989 Borst et al. ..... 204/286.1

* cited by examiner

*Primary Examiner*—Bruce F. Bell
(74) *Attorney, Agent, or Firm*—Antonio R. Durando; Durando Birdwell & Janke, PLC

(57) ABSTRACT

An electrolytic cathode consists of a solid copper hanger bar and a stainless-steel mother plate attached to a receiving groove in the underside of the hanger bar. In the preferred embodiment of the invention, the entire length of connection is welded, thereby establishing a large boundary surface for good electrical conductance. The solid hanger bar further includes a cladding of stainless steel wrapped over the copper bar and the upper portion of the mother plate, leaving only the ends of the copper bar exposed for electrical connection with conventional bus-bars. The lower edges of the cover are attached to the mother plate by a steel-to-steel weld that produces a strong and durable connection. The lateral edges of the cover are also connected to the copper bar by a conventional copper weld that completely seals the cover over the copper bar, thereby preventing contamination from the electrolytic solution. The cover is then welded to the mother plate and sealed around the copper bar. The heat produced by the welding process, which causes the steel cladding material to expand during welding, is used to improve the tightness of the fit between the cover and the copper bar as a result of the cover's shrinkage occurring during cooling.

20 Claims, 3 Drawing Sheets

STEEL-CLAD CATHODE FOR ELECTROLYTIC REFINING OF COPPER

BACKGROUND OF THE INVENTION

1. Field of the Invention

The invention relates generally to electrolytic processes and apparatus for refining metals and, in particular, to an improved stainless-steel clad electrode.

2. Description of the Prior Art

The principle of electrolysis has been utilized for decades to extract metals and other cations from an electrolytic solution. The extraction process is carried out by passing an electric current through an electrolyte solution of the metal of interest, such as copper, gold, silver, or lead. The metal is extracted by electrical deposition as a result of current flow between a large number of anode and cathode plates immersed in cells of a dedicated extraction tank house. In electrowinning processes, a solution of metal-rich electrolyte and various other chemicals, as required to maintain an optimal rate of deposition, is circulated through the extraction cells. The cathode is generally constructed of a metal alloy, such as titanium or copper alloys, and various grades of stainless steel which are resistant to corrosive acid solutions. In the most efficient processes, each cathode consists of a thin sheet of metal of uniform thickness, e.g., 2–4 mm, disposed vertically between parallel sheets of anodic material, so that a uniform current density is present throughout the surface of the cathode. On passing of an electric current through the anodes, electrolyte and cathodes, a pure layer of metal is electrodeposited on the cathode surface which becomes plated during the process.

Similarly, in a metal purification process in a refinery using electrodeposition, an anode of impure metal is placed in an electrolytic solution of the same metal and subjected to an electric current passing through the anode, electrolyte and cathode of each cell. The anode goes into solution and the impurities drop to the bottom of the tank. The dissolved metal then follows the current flow and is deposited in pure form on the cathode which typically consists of a mother plate of stainless steel. When a certain amount of pure metal has been plated onto the mother plate, the cathode is pulled out of the tank and stripped of the pure metal.

In both processes, the pure metal deposit is grown to a specific thickness on the cathode during a predetermined length of time and then the cathode is removed from the cell. It is important that the layer of metal deposited be recovered in uniform shapes and thicknesses and that its grade be of the highest quality so that it will adhere to the cathode blank during deposition and be easily removed by automated stripping equipment afterwards. The overall economy of the production process depends in part on the ability to mechanically strip the cathodes of the metal deposits at high throughputs and speeds without utilizing manual or physical intervention. To that end, the cathode blanks must have a surface finish that is resistant to the corrosive solution of the tank house and must be strong enough to withstand continuous handling by automated machines without pitting or marking. Any degradation of the finish of the blank causes the electrodeposited metal to bond with the cathode resulting in difficulty of removal and/or contamination of the deposited metal.

Also immensely important in the production and refining of metals by electrolytic extraction is the relationship of electrical power consumption with rates of metal production. A cell efficiency of ninety-five percent or better is the typical goal for the best operations. In order to achieve this level of efficiency, the voltage profile across the cathodic deposition surface must be held constant and variations avoided. Shorts due to areas of high current density caused by nodulization or by curved cathode surfaces which touch the anode must be prevented. Therefore, the details of construction of cathode blanks are very important to minimize operational problems and ensure high yields.

U.S. Pat. No. 4,186,074 to Perry describes a cathode for the electrolytic refining of copper that consists of a stainless steel hanger bar which is point-welded to a stainless steel mother plate hanging from the bar in a vertical position, as illustrated in FIG. 1. The hanger bar has a flat bottom face for maximum surface contact and corresponding maximum electrical conductance with support bus-bars through which the system is energized. In order to reduce the electrical resistance resulting from the welds between the hanger bar and the mother plate, the hanger bar and the upper edge of the mother plate are uniformly clad with copper, thereby creating a low-resistance boundary between the bar and the sheet. Additionally, in order to prevent deposit build-up along the lateral edges of the mother plate which would impede the automated separation of the product at the end of each cycle, these lateral edges are masked with an insulating strip riveted to the electrode.

U.S. Pat. No. 5,492,609 to Assenmacher disclosed an improved cathode that includes a copper hanger-bar with a rounded underside that ensures the automatic vertical position of the mother plate with respect to horizontal supporting bus-bars irrespective of warpage or construction defects. The mechanical connection between the hanger bar and the mother plate is achieved by inserting the latter's upper edge into a receiving groove in the underside of the hanger bar and by welding the entire length of connection, thereby establishing a large boundary surface for good electrical conductance.

Another development in the art is a hanger bar that consists of hollow stainless-steel tubing spot-welded to the mother plate in conventional manner. The hanger bar and the spot welds are then covered with plated copper to improve electrical conductance. The problem with this hanger-bar configuration is the fact that the copper plating tends to come off the spot welds with use, thereby creating current paths with different conductivity and nonuniform current densities.

Another type of electrode, developed primarily for use in chloride-rich environments, consists of a copper hanger-bar clad in titanium and welded to a titanium mother plate. A copper tube is first covered with a layer of titanium to produce the hanger bar. The mother plate is then either fingered around or welded to the hanger bar, or both, thereby requiring a more durable and efficient titanium-to-titanium connection between the two components. Because of the materials involved, this type of electrode is relatively expensive and its use is reserved to specialized applications.

Bartsch et al. (U.S. Pat. No. 4,647,358) have disclosed a cathode with a hanger bar consisting of a hollow copper tube clad in a tubular sheath of high grade steel. The steel sheath is preferably a tube with slightly larger diameter than the copper tube and is slidably fitted over it. The electrode's mother plate, which is also made of steel, is then welded to the steel sheath cladding the hanger bar. In order to improve the contact between the copper and steel tube sections of the hanger bar, they may be deformed to an oval shape by the application of pressure. Additional contact pressure points may be provided, such as by center-punch blows, to improve current flow between the copper and steel tubes of the hanger bar. A tight seal between the copper and steel tubes also prevents diffusion of liquid and gas and ensures a satisfactory flow of current through the cross-sections of the welds.

While these inventions have provided substantial improvements over the prior art, the maintenance of a uniform current density remains a problem due to wear, pits or other faults developed in the electrode, especially at the points of connection between the hanger bar and the mother plate. The center-punch blows of the Bartsch et al. cathode tend to create stresses in the steel wrap that may cause corrosion attacks. Although its steel-clad copper hanger bar is very desirable to improve electrical conductivity with the mother plate, its open-ended tubular configuration allows contamination and acidic corrosion inside the hollow tube. In addition, a tubular hanger bar is mechanically weaker than a solid hanger bar and more susceptible to excessive heating caused by the high current demands of today's tank houses, which in turn may cause electrical shorts and reduced quality of conductivity to the mother plate. All of these forms of damage exacerbate the normal damage caused by exposure to the corrosive atmosphere of the electrolytic tank house, rapidly leading to a build-up of high-resistance corrosion spots that decrease the conductivity of the entire electrode. Such corrosion eventually causes enough structural damage to require replacement of the hanger bar and reconditioning of the cathode.

These problems are particularly relevant for liberator and scavenger cells, which are specialized cells used to decrease the copper concentration in the electrolyte solution. In copper refining, the copper solution is processed under steady-state conditions at a concentration of approximately 44 grams of copper per liter of solution. As electroplating proceeds, the copper concentration tends to rise above optimal levels and it becomes necessary to "liberate" the excess electrolyte from the process solution. The copper concentration rises in similar fashion in electrowinning processes, creating a need for "scavenging" the excess copper from the solution. These operations are carried out in dedicated cells. Both liberator and scavenger cells can operate at relatively high amperages and unusually hot conditions, producing gases that corrode the exposed portions of the mother plate and, especially, the exposed copper of the hanger bar.

In view of the above, there still exists a need for an improved electrolytic cathode which overcomes these problems, especially with regard to liberator and scavenger cells. The present invention provides a new electrode configuration and a method of construction of such electrode that fulfill this need.

BRIEF SUMMARY OF THE INVENTION

The primary objective of this invention is an electrode and particularly a cathode that has optimal and long-lasting electrical characteristics for the electrolytic production and refining of copper.

Another objective of the invention is an electrode wherein the bearing structure that couples the hanger bar to the mother plate includes a weld between stainless steel components, thereby simplifying the process of assembly and ensuring strength and durability.

Another goal is a cathode with a solid copper hanger bar that is reliably protected from exposure to corrosive gases produced in refining and electrowinning processes.

A further objective of the invention is a cathode that is particularly suitable for use in the high-concentration and corrosive-atmosphere conditions found in liberator and scavenger cells.

Another objective is a cathode that performs reliably when used with all types of automated mechanical stripping machines, cathode handling equipment, and various types of edge strips.

Another goal of the invention is an electrically efficient cathode assembly which is capable of receiving a maximum amount of deposited metal while being easily stripped and reused during the life of its components.

Yet another objective is a design and method of manufacture for an electrode and particularly a cathode that accomplishes the above-mentioned objects in an economical and commercially viable manner.

Therefore, according to these and other objectives, the present invention consists of an electrolytic cathode comprising a solid copper hanger bar and a stainless-steel mother plate coupled by inserting the upper edge of the mother plate into a receiving groove in the underside of the hanger bar. In the preferred embodiment of the invention, the entire length of connection is welded, thereby establishing a large boundary surface for good electrical conductance. A cover of stainless steel is wrapped over the copper bar and the upper portion of the mother plate, leaving only the ends of the solid copper bar exposed for connection to conventional bus-bars. The lower edges of the steel cover are attached to the mother plate by a stainless-steel to stainless-steel weld that produces a strong and durable connection. The lateral edges of the cover are attached around the perimeter of the copper bar by conventional deoxygenated copper welds, or equivalent molybdemum/copper or other alloy welds, to completely seal the cover around the copper bar and over its points of connection to the mother plate, thereby preventing contamination from the electrolytic solution and process gases.

According to another aspect of the invention, the step of wrapping the steel cover over the solid copper hanger bar is carried out by molding, mechanically folding, stamping, or roll forming the cover around the copper bar, such as to produce intimate contact between the copper and steel surfaces. The cover is then welded to the mother plate and sealed around the copper bar. The heat produced by the welding process, which causes the steel cladding material to expand during welding, is also advantageously used to improve the tightness of the fit between the cover and the copper bar as a result of the cover's shrinkage occurring during cooling.

Various other purposes and advantages of the invention will become clear from its description in the specification which follows and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose only some of the various ways in which the invention may be practiced.

DESCRIPTION OF THE PREFERRED EMBODIMENTS OF THE INVENTION

The heart of this invention lies in the idea of using a solid copper hanger-bar and cladding it with a stainless steel sheet formed around the hanger bar and welded to the stainless-steel mother plate. The result is a hanger bar of maximum mechanical strength, reduced resistance and correspondingly reduced heat generation. In addition, the steel-to-steel weld provides increased structural support for the electrode. According to another aspect of the invention, the steel cladding is roll formed around the solid copper bar, which provides a rapid and efficient way to envelope the bar ensuring good contact between the copper and steel surfaces. As used herein, the term "solid" is intended to mean without an internal cavity.

Figure 1:
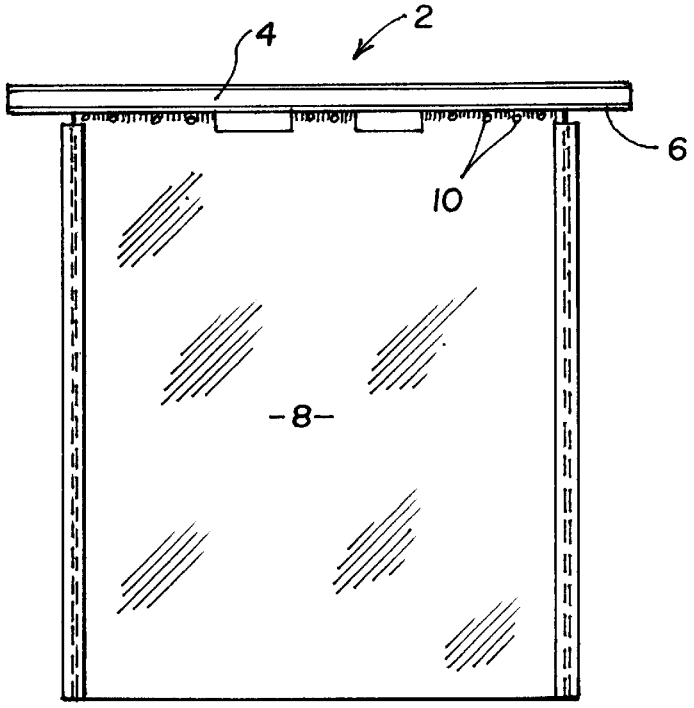
FIG. 1 (PRIOR ART)
FIG. 1 is an elevational view of a prior-art cathode for the electro-deposition of copper electrolytes.
Figure 2:
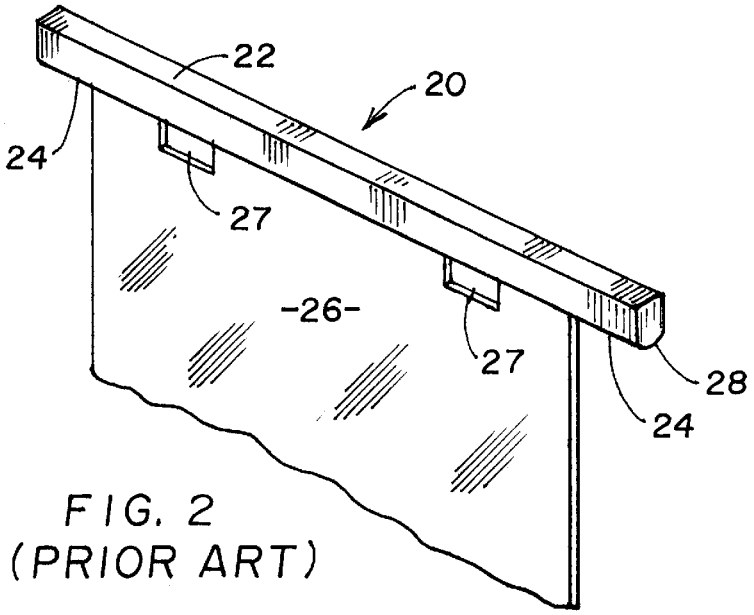
FIG. 2 (PRIOR ART)
FIG. 2 is a partial perspective view of another prior-art cathode for the electro-deposition of copper electrolytes manufactured according to techniques relevant to the present invention.
Figure 3:
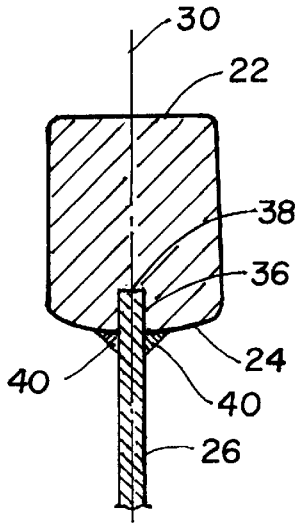
FIG. 3 (PRIOR ART)
FIG. 3 is a cross-sectional side view of the cathode of FIG. 2 as seen from line 3—3 in FIG. 4.

As illustrated in elevational view in FIG. 1, an electrolytic cathode 2 according to the prior art includes a stainless-steel hanger bar 4 with a flat underside 6 and a mother plate 8 (normally stainless steel) that abuts and is attached to the underside 6 by means of a plurality of stitch welds 10 along the upper edge of the mother plate. The whole attachment is encased in an electroplated copper coating. As mentioned above, these features often produce operational problems.

FIGS. 2–5 show another prior-art cathode with improved structural features that are relevant to the present invention. As seen in partial perspective view in FIG. 2, such a cathode 20 comprises a header bar or hanger bar 22 with a uniformly rounded underside 24 (that is, having a convex cross-section). A flat mother plate 26 is attached to the hanger bar substantially along the lowest region 28 of the underside, in alignment with the cross-sectional vertical axis 30 of the hanger bar, as clearly illustrated in the partial side section of FIG. 3. The curvature of the underside 24 allows its rotation toward a vertical position over conventional horizontal supporting bus-bars found in conforming electrolytic cells. Thus, the mother plate 26 can automatically dispose itself by gravity in a substantially vertical position with its center of gravity aligned with the line of contact of the hanger bar with the supporting bus-bar. Like all standard cathodes used in the industry, the mother plate 26 (also called mother plate or mother blank in the industry) contains windows 27 at the top end to provide openings for mechanical handling of the cathode by automated equipment.

By ensuring the vertical positioning of each cathode between parallel anodes in the electrolytic cells, this feature optimizes the uniformity of separation between electrodes and, given any structural imperfections in the mother plates, provides optimal distribution of current flow and metal deposition. This is a great advantage during the typically long lifetime of a cathode (in the order of many years) because it reduces the incidence of electrical shorts that warping and other damage to the mother plate may cause. It is noted that the typical thickness of a mother plate is from about 2.9 to 3.2 mm, and that the face-to-face distance between cathode and anode is in the order of millimeters (such as 25 mm). Therefore, any imperfection in the flatness or verticality of the mother plate could readily result in costly electrical shorts.

In conventional electrolytic equipment, the hanger bar is approximately 130 cm long, 2.5 cm wide and 3.8 cm high; and the typical mother plate is 110 cm high, 100 cm wide and 3 mm thick. A radius of curvature of about 5 cm ensures freedom of rotation of this type of cathode to achieve a vertical position simply as a result of gravitational forces.

Another improvement provided by this type of cathode consists of the connection between the hanger bar 22 and the mother plate 26. Instead of relying on low-conductance stitch welds between the two and then cladding them with a highly conductive layer of copper to improve performance, as shown in FIG. 1, the cathode 2 utilizes a copper hanger bar with a continuous weld connection along the entire top edge of the mother plate. Thus, electrical conductivity at the boundary is greatly increased and copper cladding becomes unnecessary.

Figure 4:
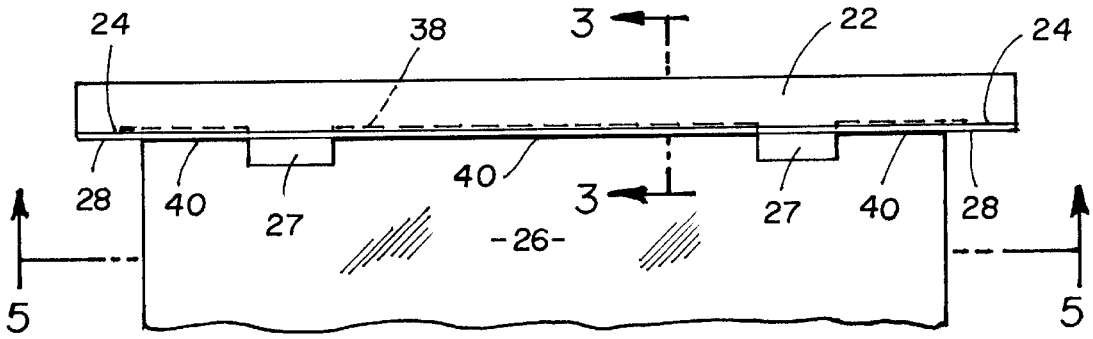
FIG. 4 (PRIOR ART)
FIG. 4 is a partial elevational view of the cathode of FIG. 2 illustrating the method of assembly of the copper hanger bar with the stainless-steel mother plate.
Figure 5:
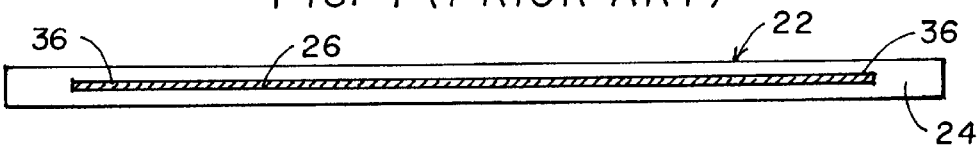
FIG. 5 (PRIOR ART)
FIG. 5 is a cross-sectional bottom view of the cathode of FIG. 2 as seen from line 5—5 in FIG. 4.

As shown in FIGS. 4 and 5, a longitudinal inset groove 36 is milled along the center of the underside 24 of the hanger bar 22 for receiving the top edge 38 of the mother plate 26. The groove 36 is cut with the proper clearance to allow the metal-alloy blade (normally a stainless steel) constituting the mother plate 26 to fit tightly without being forced, and the groove is of sufficient length to accommodate the full length of the top edge 38. The two units are then welded together, so that the copper hanger bar and the mother plate are bonded into one electrically compatible unit with the strength of a continuously welded structure. Typically, the copper/steel connection is accomplished by arc-welding in a tungsten inert gas (T.I.G.) process with a copper rod 40 placed along the entire length of the insert on both sides of the edge 38. The assembled components are illustrated in the cross-sectional view of FIG. 3. This method of construction eliminates the need for cladding the hanger-bar/starter-sheet assembly with a high conductivity metal to improve cathode performance, as previously done in the art (see U.S. Pat. No. 4,186,074). Therefore, it eliminates one step from the manufacturing process and avoids the corrosion and reduced-efficiency problems associated with wear of the cladding during the life of the cathode. For very corrosive atmospheres, though, such as encountered in liberator and scavenger cells, the problem of hanger-bar damage persists, especially at the point of connection between the copper hanger bar and the steel starter plate. Similarly, the improved hanger-bar configuration disclosed by Bartsch et al. is not a completely adequate solution because of its hollow structure, which is susceptible to internal contamination and does not provide sufficient thermal dissipation to withstand the heat stresses associated with the relatively high currents of liberator and scavenger cells, which in turn results in reduced electrical conductivity between the hanger bar and the mother plate. Since corrosion, imperfections in the welds between components, and extreme temperature and current operating conditions affect the current distribution through the cathode, this invention is directed particularly at minimizing the effects of such variables.

Thus, the present invention consists of adding a layer of stainless steel cladding closely wrapped around a solid copper hanger bar and around the welded connection between the bar and the starter plate, so that they are both completely enclosed and sealed from exposure. An advantage of this electrode over the one disclosed by Bartsch et al. is in the use of a solid copper hanger bar, which is mechanically stronger, has a lower electrical resistance, and provides a greater mass for absorbing and dissipating the heat generated by current flow (that is, it constitutes a better heat sink). In addition, a solid hanger bar eliminates the interior contamination and corrosion that may be associated with a hollow bar.

Figure 6:
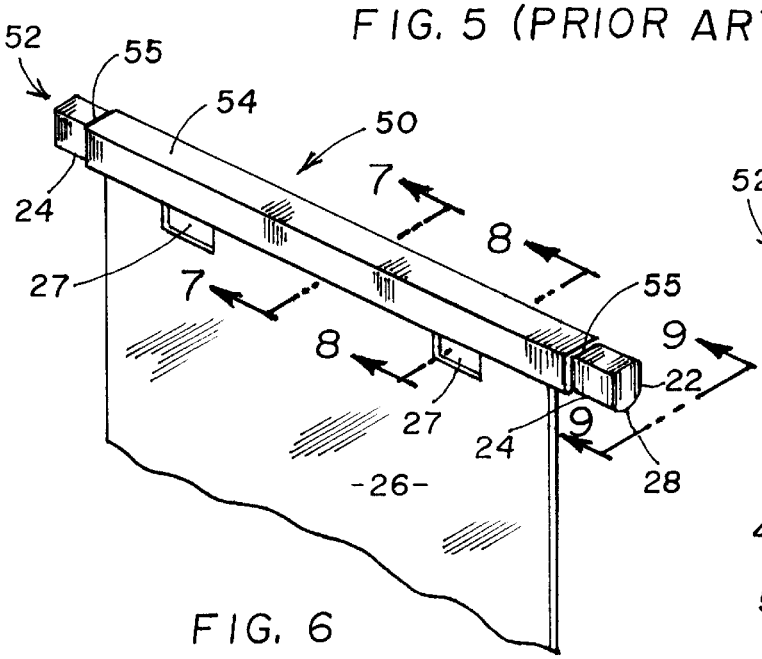
FIG. 6 shows in partial perspective view a cathode that includes a stainless-steel cladding according to the present invention.
Figure 7:
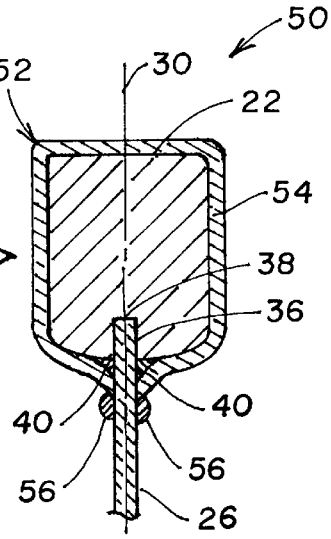
FIG. 7 is a cross-sectional side view of the cathode of FIG. 6 as seen from line 7—7 in that figure.
Figure 8:
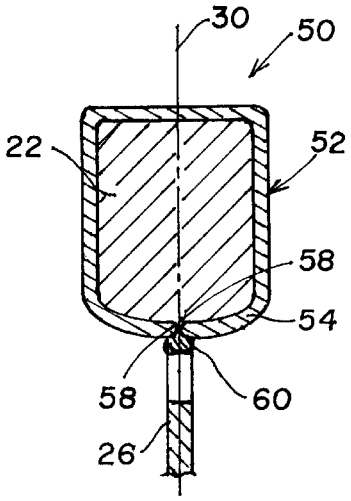
FIG. 8 is a cross-sectional side view of the cathode of FIG. 6 as seen from line B8—8 in the figure.
Figure 9:
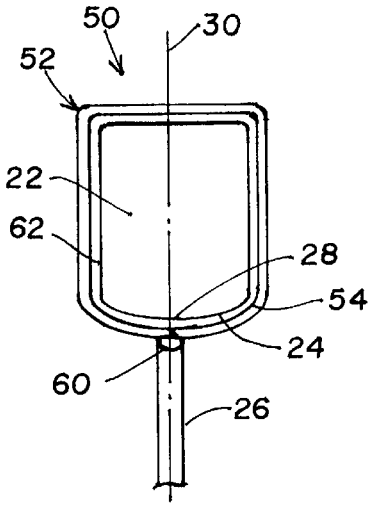
FIG. 9 is a side view of the cathode of FIG. 6 as seen from line 9—9 in the figure.
Figure 10:
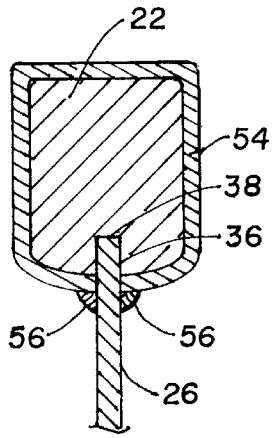
FIG. 10 is a cross-sectional side view showing the connection of an embodiment wherein the mother plate is press-fit into the copper hanger bar, thereby eliminating welds therebetween.

Referring to the drawings of the invention, wherein like parts are designated throughout with like numerals and symbols, FIG. 6 shows in partial perspective view a cathode 50 with a hanger bar 52 that, according to the present invention, includes a stainless-steel cladding or cover 54 over the solid copper bar 22 illustrated in FIGS. 2–5. The steel cover is wrapped around the bar 22 to fit as tightly as possible and overlap the copper-rod welds 40 connecting the copper bar to the mother plate 26, as illustrated in cross-section in FIG. 7. The cover 54 is not extended laterally much beyond the width of the mother plate, so that the end portions of the copper bar 22 are left exposed for contact and optimal electrical connection with the bus-bars of the electrolytic cell. The entire edge of the cover 54 is then welded to the mother plate 26 and to the copper bar 22. The steel-to-copper weld is preferably carried out by arc-welding in a T.I.G. process with a copper rod, or other equivalent alloy rod, placed around the perimeter of the bar 22 along the lateral edges 55 of the cover 54. The steel-to-steel weld, on the other hand, can be carried out in conventional manner using steel rods 56 (FIG. 7) placed along the bottom edges of the cover 54 in contact with the mother plate 26. It is preferable to wrap the cover 54 completely around the copper bar also through the windows 27, overlapping or butting the cover's two edges 58 to completely clad the underside 24 of the hanger bar, as shown in FIG. 8. A steel-to-steel weld 60 is similarly used to seal from exposure the copper portion of the hanger bar enclosed within the cover 54. Thus, the entire length of the edge of the cladding 54 is sealed against the copper bar 22 and the mother plate 26, thereby preventing contamination, corrosion, and all attendant maintenance problems. FIG. 9 is a side view of the hanger bar 52, as seen from line 9—9 in FIG. 6, to illustrate the steel-to-copper weld 62 of the edge 55 around the copper bar 22. It is noted that the cathode 50 of the invention described in FIGS. 6-9 contains two separate welds that provide support between the hanger bar 54 and the mother plate 26, thereby materially strengthening the connection between the two. The first is the copper-to-steel weld 40; the second is the steel-to-steel welds 56 and 60. Therefore, because of the proven reliability of steel-to-steel welds, in some cases it is possible to eliminate the copper-to-steel weld 40 and rely simply on a press-fit connection between the copper bar 22 and the mother plate 26, as illustrated in the cross-sectional view of FIG. 10, without material loss of reliability. This is another advantage of a solid hanger bar over a tubular configuration. Obviously, this option, when safely available, affords a significant simplification of manufacture and corresponding cost savings. The preferred material for manufacturing the apparatus of the invention is solid copper for the bar 22 and stainless steel (316L, 2205 or other steel alloys) for the cover 54 and the mother plate 26. These two steel components are preferably made of the same material to facilitate welding between them. Thus, as used herein, "same material" is intended to refer to materials composed of the same primary metal (i.e., iron) and sufficiently similar and compatible to be suitable for welding to one another using conventional methods, such as the same or different kinds of stainless steel.

Figure 11:
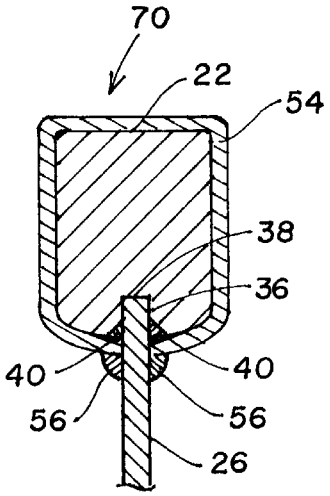
FIG. 11 is a cross-sectional side view showing the connection of an embodiment wherein the groove in the copper hanger bar has been beveled to minimize protrusions caused by the welds between the bar and the mother plate.

In another embodiment 70 of the invention illustrated in FIG. 11, the groove 36 in the copper bar 22 is beveled at the edges and the resulting insets are used advantageously as channels for placing the copper weld rods 40 connecting the copper portion 22 of the hanger bar to the mother plate. By so removing the protrusions inevitably resulting from the weld rods 40 when the groove 36 is not beveled, as illustrated in the first embodiment of FIG. 7, it is possible to wrap the cover 54 more tightly around the weld line and avoid the formation of air pockets that can collapse inward during use and cause rupture of the steel cladding.

Figure 12:
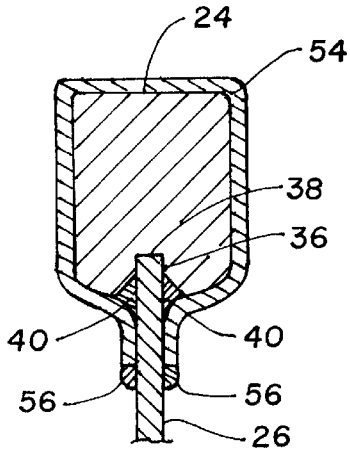
FIG. 12 is a cross-sectional side view showing the connection of an embodiment wherein the cover is extended in fingering fashion over the mother plate.

While the invention has been described in terms of a stainless steel cover added to the particular hanger bar 22, it is clear that it can be practiced in equivalent fashion with any solid prior-art hanger bar, regardless of its configuration. The idea is to isolate the connection spots between the mother plate and the copper portion of the hanger bar in order to prevent the damage normally produced by process gases, mechanical stresses, and abuse. The cladding 54 could also equivalently be extended below the weld points 40, in fingering fashion, as illustrated in cross-section in FIG. 12.

The step of wrapping the stainless steel cover 54 over a solid copper hanger bar can be carried out according to various procedures known for that purpose. The cover could be molded, mechanically folded, or stamped around the copper bar, the most important issue being the ability to produce intimate contact between the copper and steel surfaces. Preferably, the stainless steel sheet is roll formed over the copper bar, which is known to produce a very close conformity and connection between the copper bar and the stainless steel sheet cover.

The cover is then welded to the mother plate and sealed around the copper bar (also by welding). According to another aspect of the invention which is advantageous over the prior art, the heat produced by the welding process necessarily causes the steel cladding material to expand during welding at a relatively greater rate than the solid copper bar, which has much greater mass and therefore experiences a materially smaller temperature rise. Thus, after the cover is welded to the mother plate, it tends to shrink more than the copper bar during cooling, thereby further improving the tight fit between the two, as desired.

It is noted that the features of the invention are applicable to any combination of materials suitable for any given electrolytic process, so long as the starter-sheet metal is appropriate for the electro-deposition of the electrolyte and the hanger-bar cover metal is a good conductor and can be welded to the hanger bar. In all such cases, the advantages of the invention are achieved by wrapping the solid hanger bar, as taught herein, in a cover made of the same material as the mother plate and sealing all of the cover's edges to prevent contamination. Similarly, the invention is not limited to cathodes because it would be equally applicable to the manufacture of anodes requiring similar characteristics.

The term "hanger bar" has been used in this disclosure with reference to the hanger bar of the invention, which includes the sealed metal cladding, as well as with reference to its solid copper core only, which consists of conventional hanger-bar configurations. The distinction between the two usages of the term is believed to be clear from the context.

In essence, the invention consists of a solid hanger bar of a predetermined material clad in a cover of a different material which is substantially the same as the material of the mother plate. The cladding process is preferably carried out through a roll-forming step followed by a welding step. Both the manufacturing procedure and the resulting electrode are believed to provide significant advantages over the prior art, as explained above.

Various other changes in the details, steps and materials that have been described may be made by those skilled in the art within the principles and scope of the invention herein illustrated and defined in the appended claims. Thus, while the present invention has been shown and described herein in what is believed to be the most practical and preferred embodiments, it is recognized that departures can be made therefrom within the scope of the invention, which is not to be limited to the details disclosed herein but is to be accorded the full scope of the claims so as to embrace any and all equivalent apparatus and methods.

I claim:

1. A method of manufacture of an electrode for an electrolytic process comprising the following steps:

(a) attaching a mother plate to a solid hanger bar;

(b) cladding said solid hanger bar with a cover sealingly adhered thereto; and (c) attaching said cover to the mother plate.

2. The method of claim 1, wherein the hanger bar is made of a first material, the mother plate is made of a second material, and the cover is made of a material which is the same as said second material.

3. The method of claim 2, wherein the electrode is a cathode, the first material is copper, and the second material is stainless steel.

4. The method of claim 3, wherein said step (a) is carried out by press-fitting the mother plate into the hanger bar; said step (b) is carried out by roll forming the cover over the hanger bar; and said step (c) is carried out by welding the cover to the mother plate.

5. A cathode manufactured according to the method of claim 4.

6. The method of claim 3, wherein said step (a) is carried out by welding the mother plate to the hanger bar; said step (b) is carried out by roll forming the cover over the hanger bar; and said step (c) is carried out by welding the cover to the mother plate.

7. A cathode manufactured according to the method of claim 6.

8. The method of claim 1, wherein said step (a) is carried out by press-fitting the mother plate into the hanger bar.

9. The method of claim 1, wherein said step (a) is carried out by welding the mother plate to the hanger bar.

10. The method of claim 1, wherein said step (b) is carried out by roll forming the cover over the hanger bar.

11. The method of claim 1, wherein said step (c) is carried out by welding the cover to the mother plate.

12. An electrode manufactured according to the method of claim 1.

13. An electrode for an electrolytic process comprising:

a solid hanger bar;

a mother plate attached to the hanger bar at predetermined points of connection; and a cover wrapped around said hanger bar such as to sealingly enclose said points of connection;

wherein the hanger bar is made of a first material, the mother plate is made of a second material, and the cover is made of a material which is the same as said second material.

14. The electrode of claim 13, wherein the electrode is a cathode, the first material is copper, and the second material is stainless steel.

15. The electrode of claim 13, wherein the cover is welded to the mother plate below said points of connection, such as to provide a first continuous seal between the cover and the mother plate; and the cover is further welded to the hanger bar along two lateral perimeters thereof, such as to provide a pair of second continuous seals between the cover and the hanger bar.

16. The electrode of claim 13, wherein said points of connection include welded joints between the hanger bar and the mother plate.

17. The electrode of claim 16, wherein the cover is welded to the mother plate below said welded joints, such as to provide a first continuous seal between the cover and the mother plate; and the cover is further welded to the hanger bar along two lateral perimeters thereof, such as to provide a pair of second continuous seals between the cover and the hanger bar.

18. The electrode of claim 13, wherein said points of connection include press-fit joints between the hanger bar and the mother plate.

19. The electrode of claim 18, wherein the cover is welded to the mother plate below said press-fit joints, such as to provide a first continuous seal between the cover and the mother plate; and the cover is further welded to the hanger bar along two lateral perimeters thereof, such as to provide a pair of second continuous seals between the cover and the hanger bar.

20. The electrode of claim 13, wherein said cover extends in fingering fashion over the mother plate below said points of connection.

* * * * *